United States Patent [19]

Garcia

[11] 3,936,054

[45] Feb. 3, 1976

[54] BOARD GAME APPARATUS

[76] Inventor: Luis Garcia, 2032 S. Second Ave., Maywood, Ill. 60153

[22] Filed: Nov. 29, 1974

[21] Appl. No.: 528,334

[52] U.S. Cl.... 273/134 AD; 273/134 C; 273/134 E; 273/142 JA

[51] Int. Cl.[2] ..... A63F 3/00

[58] Field of Search ..... 273/134

[56] References Cited

UNITED STATES PATENTS

| | | | |
|---|---|---|---|
| 626,853 | 6/1899 | Boig | 273/134 AD UX |
| 1,505,071 | 8/1924 | Fraser | 273/134 AD |
| 1,615,927 | 2/1927 | Atkinson | 273/134 E |
| 1,707,184 | 3/1929 | Bauer | 273/134 E UX |
| 3,851,881 | 12/1974 | Smith | 273/134 AC |

*Primary Examiner*—Delbert B. Lowe
*Attorney, Agent, or Firm*—Philip D. Amins

[57] ABSTRACT

A board game apparatus includes a playing board divided into a multiplicity of adjacent playing areas forming a main course. The main course includes a plurality of playing areas having penalties, rewards, instructions and numerical indicia thereon, all of which are randomly interposed. A plurality of secondary playing areas having consecutive numerical indicia thereon and two colored areas are disposed without the main playing course. In addition, the board includes a dial indicator which is adapted to rotate and indicate a numerical quantity of main course playing areas along which a player moves his distinctive token, subject to the instructions found thereon. Monetary tokens are used to comply with the penalty and reward requirements during the playing of the game. Wagering tokens adapted to be placed on the secondary playing and colored areas indicate the numbers and colors wagered on by the players. Two decks of cards are also provided; one deck has indicia thereon which provides the wagering instructions, the other deck has indicia thereon which provides the penalty and reward instructions.

12 Claims, 9 Drawing Figures

BOARD GAME APPARATUS

BACKGROUND OF THE INVENTION

The present invention relates to a board game apparatus, and more particularly to a board game apparatus of the type having a main course which includes a plurality of playing areas of substantially equal size along which player owned tokens are moved as determined by chance until a specified sum of money is acquired.

The type of game of the present invention is that type in which a substantially flat playing board is utilized, the upper surface of which is provided with suitable representations or markings indicating a main playing course which includes a plurality of generally equal playing areas. Secondary playing areas are also provided. These secondary areas include a plurality of equally sized areas having numerical indicia thereon aligned in double file in a straight line. Additionally, playing areas of first and second colors are provided.

During the play of the game, the playing pieces, one owned by each of the players, are moved along the main course complying with the instructions found on a plurality of playing areas. The main course playing areas which have instructions thereon are colored in one or more colors and are interposed between the areas having numerical indicia thereon. Each of the players moves his individual distinctive token around the main course path in accordance with the numerical indication obtained by rotating a dial indicator provided on the playing board. A player who lands on a playing area having the proper instructions thereon is then permitted to exercise his gambling instincts by placing a wager on numerical indicia and on a particular color. The player then attempts to have the selected number or color indicated by the dial indicator when it comes to rest after being rotated again. Each of the players utilizing skill and by the element of chance attempts to accumulate a prescribed amount of monetary tokens, e.g., $500,000 or $1,000,000 after which the game is terminated and the individual accumulating the specified sum of monetary tokens is declared the winner.

Many of the board games known in the prior art merely involve movement of the player's tokens around a playing path or course in a manner determined by chance in accordance with a means such as dice, dial indicator, or pointer arranged to be rotated, and the like. The prior art games frequently are thus reduced to games of chance with little skill involved. However, the present invention combines the elements of chance with some measure of skill, since a player must determine the amount of monetary tokens and the number of times he places wagers. Thus, the present invention requires the players to use skill and intelligence in acquiring the prescribed sum of money in order to be declared a winner.

Accordingly, the primary object of the present invention is to provide a novel and stimulating board game apparatus.

Another object of the present invention is to provide a game apparatus which requires players to exercise good judgment, skill and the like, during the competitive play so that the winning player will require more than just luck.

A further object of the present invention is to provide a new and improved game apparatus which is simple in construction, inexpensive to manufacture and provides excitement and enjoyment during the play of the game for the participating players.

A board game apparatus for a plurality of players, according to the principles of the present invention, comprises, in brief, a playing board having a continuous main course which is divided into a plurality of adjacent playing areas, a portion of the plurality of main course playing areas having penalties, rewards and instructions associated therewith to which the players must respond. The remaining portion of the plurality of main course playing areas are provided with numerical indicia thereon. The playing areas are randomly interposed and disposed to form the main course. The board further includes differently colored playing areas having consecutive numerical indicia thereon disposed separate from the main course on the board. Each of the secondary playing areas corresponds with a main course playing area having numerical indicia thereon. The playing board additionally includes a generally centrally disposed dial indicator rotatably affixed thereon and adapted to rotate and indicate a numerical quantity when coming to rest. Also included is a plurality of distinctive tokens constituting playing pieces. One of the tokens is utilized by each of the players in playing the game. Monetary tokens are provided for the payment of rewards and penalties by players whose tokens land on a main playing area having such instructions. Additionally included are wagering tokens for placement on the secondary areas and the different colored areas to indicate the areas selected and the amounts wagered. A plurality of cards having numerical indica thereon corresponding to the main path numerical indicia are provided. The cards with numerical indicia thereon are obtained by the players under prescribed conditions and ownership thereof provides rewards of monetary tokens under specific conditions. Two decks of cards are also provided; the cards of one of the decks have indicia thereon indicating wagering instructions, the cards of the other deck have indicia thereon indicating penalty or reward instructions. A player is directed to select a card from one of the decks of cards in accordance with the instructions provided on the main course playing areas.

BRIEF DESCRIPTION OF THE DRAWINGS

The foregoing and other objects, features and advantages of the present invention will become more apparent from the detailed description hereinafter considered in conjunction with the accompanying drawings, wherein.

DETAILED DESCRIPTION OF THE PREFERRED EMBODIMENT

Figure 1:
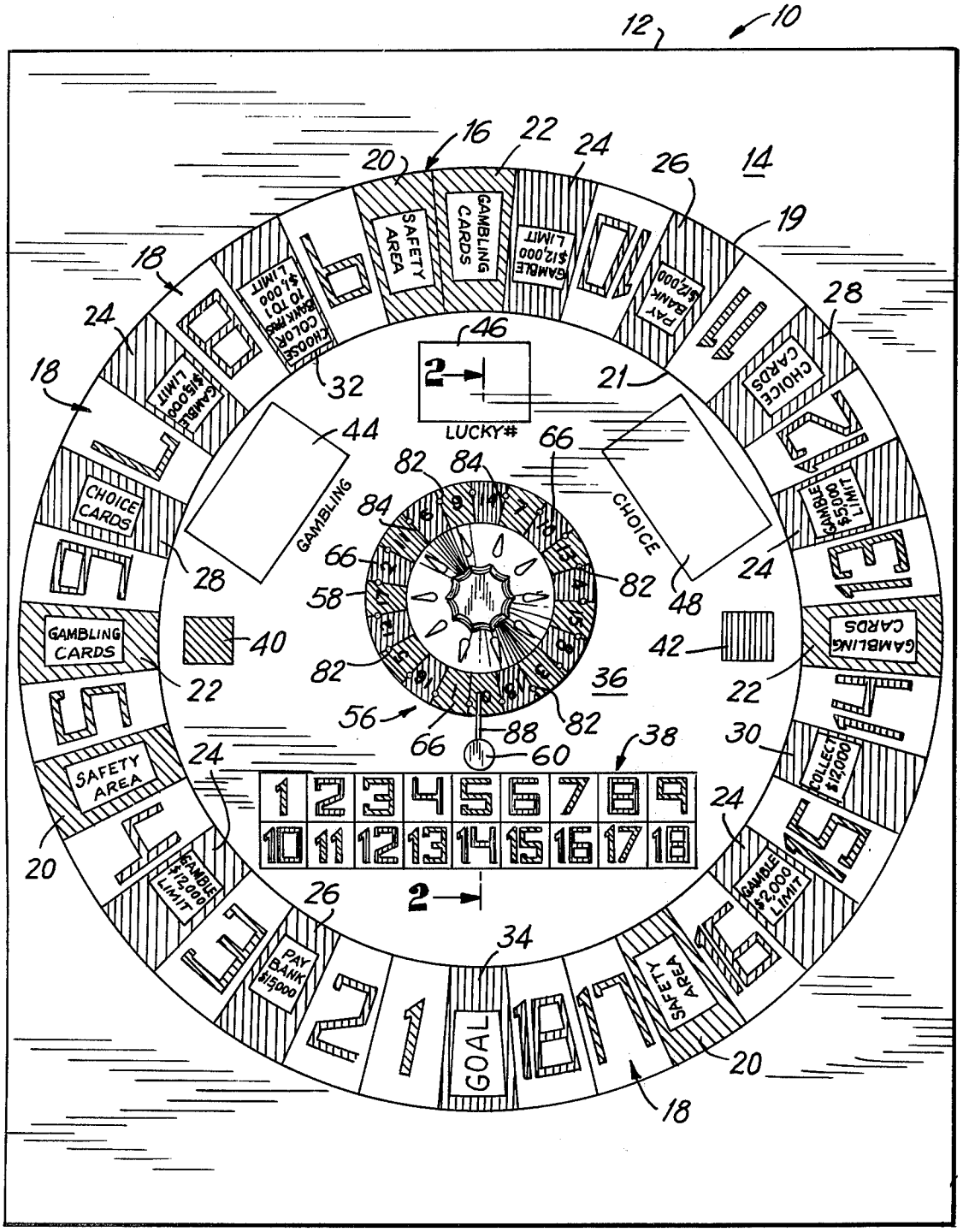
FIG. 1 is a plan view of a playing board for a board game apparatus constructed in accordance with the present invention, portions of which are suitably colored according to the color symbols for draftsmen prescribed in 37 C.F.R. 3.61.

Referring now to the drawings, and to FIG. 1 in particular, the game apparatus 10 of the present invention includes a playing surface which is preferably in the form of a board 12. In the preferred embodiment, the board 12 is of substantially rectangular configuration, as shown, and contains an upper surface 14 on which is provided, by printing or the like, suitable indicia and graphic illustrations in accordance with the invention, as will be explained hereinafter. While any name suitable for the game apparatus of the present invention may be employed, the game is preferably referred to as "GAMBELOSO," a name which suggests the playing aspects of the game and in the preferred configuration may be played by up to thirteen players.

In order to provide a playing field for the players, a playing path or main course designated generally by the numeral 16 is divided into a multiplicity of playing areas 18. These areas are preferably formed by dividing the area provided by two concentric circles of different diameters (19 and 21) into equal subdivisions. In the preferred embodiment, main course 16 includes 36 of such playing areas 18. Of these main course playing areas 18, a plurality (18 in number) are provided with numerical indicia preferably ranging from the numeral 1 through and including the numeral 18. The remaining portion of the plurality of playing areas 18 includes thereon indicia which indicate penalties, rewards and instructions to which the players must respond. Typical instructions may include Safety Areas 20, directions to pick Gambling Cards 22, Gamble with a prescribed limit 24, Pay Bank a fixed sum 26, directions to pick Choice Cards 28, Collect a fixed sum 30, Choose Color 32 and wager, and Goal 34. The function of each of these playing areas will be described hereinafter. The playing areas 18 which are provided with instructional indicia thereon are preferably colored for easy recognition and are randomly interposed between the playing areas provided with numerical indicia thereon.

The area 36 within the circle 21, in the preferred embodiment, is provided with secondary playing areas 38 which are generally equal in size and which are placed in a straight line in a double file. The areas 38 are provided with consecutive numerical indicia thereon. Each of said secondary areas corresponds with a main course playing area 18 having a numerical indicia thereon and which is accessible to all players. The area 36 further includes differently colored playing areas such as areas 40 and 42, which in the preferred embodiment, are green and red, respectively. The function of the secondary and colored playing areas will be discussed in detail hereinafter.

Additional rectangular shaped areas 44, 46 and 48 are provided on the surface 14 of board 12 disposed within area 36 and are utilized for placing the Gambling deck of cards 50, the Lucky Number Cards 52 and the Choice deck of cards 54, respectively.

Figure 3:
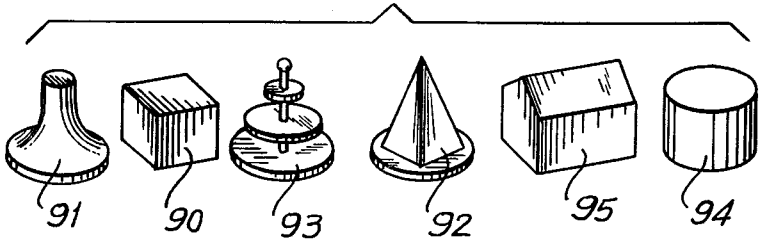
FIG. 3 is a pictorial representation of a typical assortment of distinctive tokens which may be utilized by the players during the play of the game.
Figure 2:
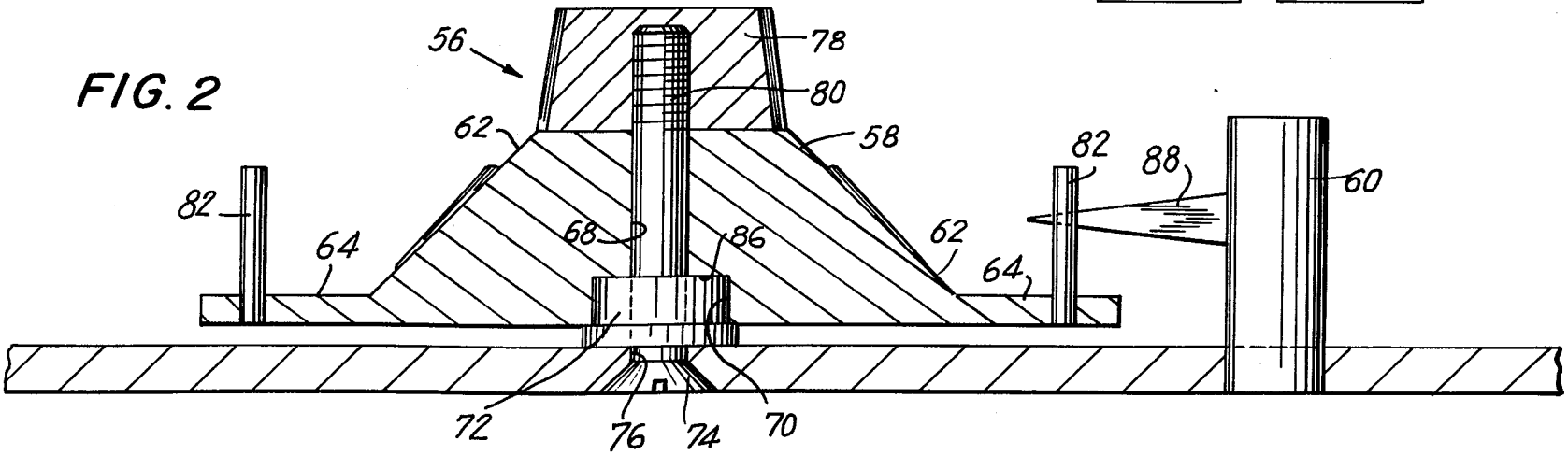
FIG. 2 is a cross-sectional view taken substantially along the line 2—2 in FIG. 1.
Figure 6:
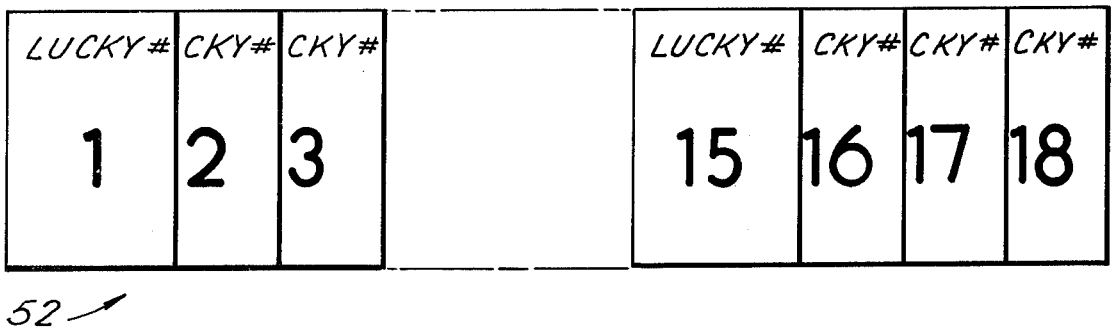
FIG. 6 is a pictorial representation of a plurality of cards, each card having a numerical indicia thereon corresponding to the main path numerical indicia.

In addition, centrally disposed within the area 36, is a dial indicator 56. The dial indicator 56 includes a rotatably mounted wheel 58 and an indexing post 60 shown in cross section in FIG. 2. The wheel 58 is preferably frustoconically shaped with sloped sidewalls 62 terminating in an annular shaped flange 64 which is preferably divided into equal areas 66 having alternately disposed colors and numerical indicia thereon corresponding to the numerical indicia provided on the main playing areas 18 plus the numeral 0. Centrally disposed within wheel 58 is a through aperture 68 which terminates in a larger diameter aperture 70 adapted to receive a shoulder bushing 72. A flat-head screw member 74 is adapted to be inserted through aperture 76 centrally provided in the playing board 12 and then forceably receive a bushing 72 thereon so as to retain the screw member 74 in a vertical position in the board 12. Wheel 58 is then mounted on screw member 74 and rotatably retained thereon by a knob 78 threaded upon the threads 80 provided on screw member 74. Vertical post members 82 are positioned on each boundary line 84 of the wheel areas 66. A clockwise or counterclockwise force exerted by a player on the vertical members 82 causes the wheel 58 to rotate on the surface 86 of bushing 72. When wheel 58 comes to rest, the extending pointer member 88 provided on the indexing post 60 will point to a wheel area 66 between two post members 82. A player may then move his distinctive token, a typical group of which is shown at 90, 91, 92, 93, 94 and 95 in FIG. 3., the number of playing areas 18 indicated by the numeral indicia on the wheel area 66 appearing under the pointer member 88.

Figure 4:
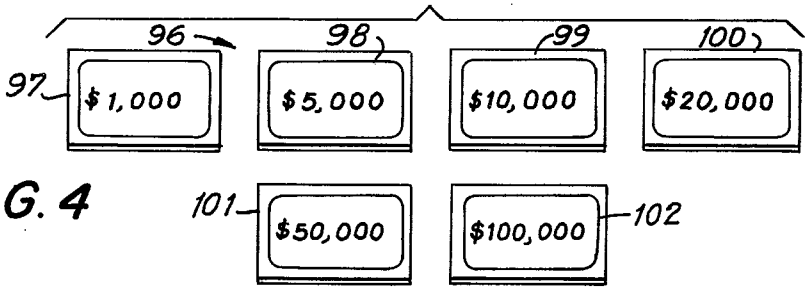
FIG. 4 is a pictorial representation of monetary tokens or play money.

The monetary tokens, or play money 96, are provided in various denominations for the play of the game and a typical embodiment thereof is shown in FIG. 4. The money may be of any denominations and preferably is provided in denominations of $1,000, $5000, $10,000, $20,000, $50,000, and $100,000 bills as shown at 97, 98, 99, 100, 101 and 102, respectively.

Figure 5:
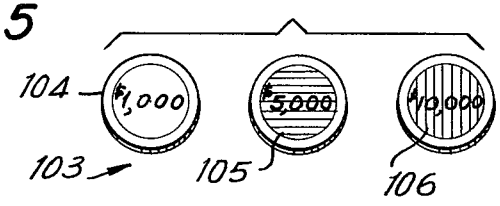
FIG. 5 is a pictorial representation of wagering tokens.

Wagering tokens or chips 103 are also provided in various denominations for use during the play of the game and are shown in FIG. 5. The wagering tokens 103 are preferably provided in denominations of $1,000, $5,000, and $10,000 as shown at 104, 105 and 106, respectively, and are preferably colored white, blue and red, respectively, for easy recognition.

A plurality of cards 52, periodically referred to herein as Lucky Number Cards, are provided with numerical indicia thereon; one card corresponding to each of the numerical indicia provided on the main path playing areas 18 and correspondingly to the numerical indicia provided on each of the wheel areas 66. The functioning of these cards is best described in the instructions for the play of the game. Suffice it to say that at this time ownership of a Lucky Number Card 52 will bring periodic monetary rewards. These cards may be kept in the area 46 provided on the surface 14 of playing board 12.

Figure 7:
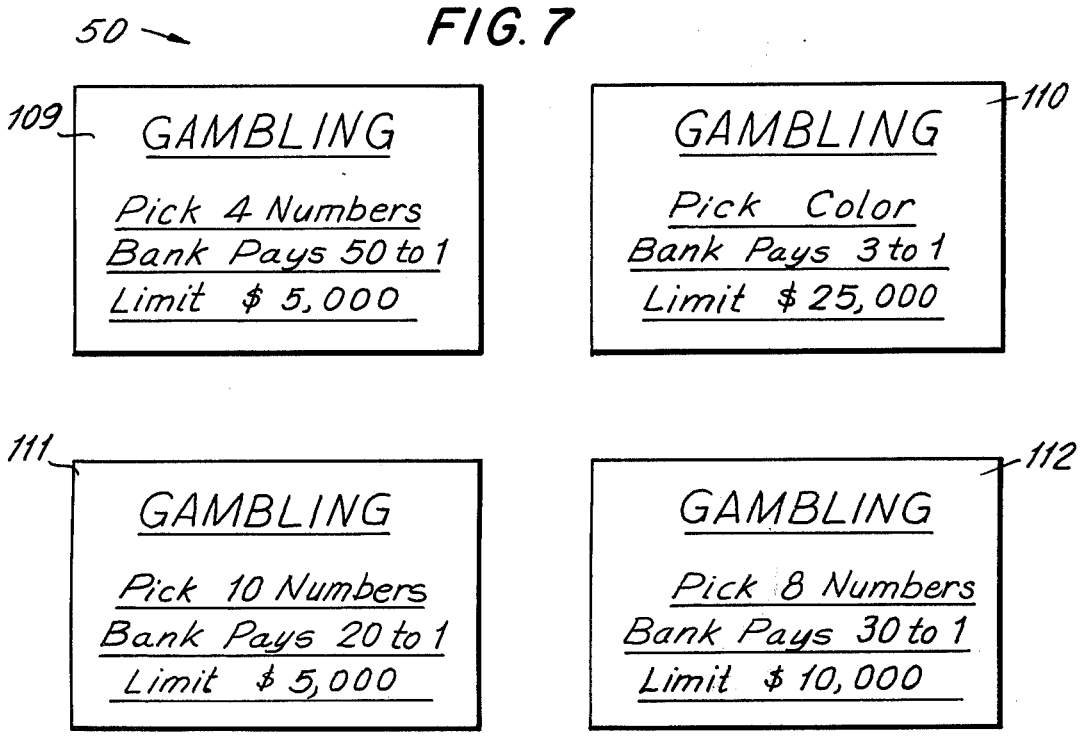
FIG. 7 is a pictorial representation of a deck of cards, each card having the indicia thereon indicating wagering instructions.

Two decks of cards are provided. A first deck of cards 50 is known as the Gambling Deck. The cards of this deck are provided with indicia thereon indicating wagering instructions, as for example, shown at 109, 110, 111 and 112 of FIG. 7. A player is directed to pick one of these cards from the deck placed face down on the area provided at 44 on the surface 14 of the playing board 12 when his distinctive token lands on a main course playing area directing him thereto. The player may then gamble in accordance with the instructions found on the card.

Figure 8:
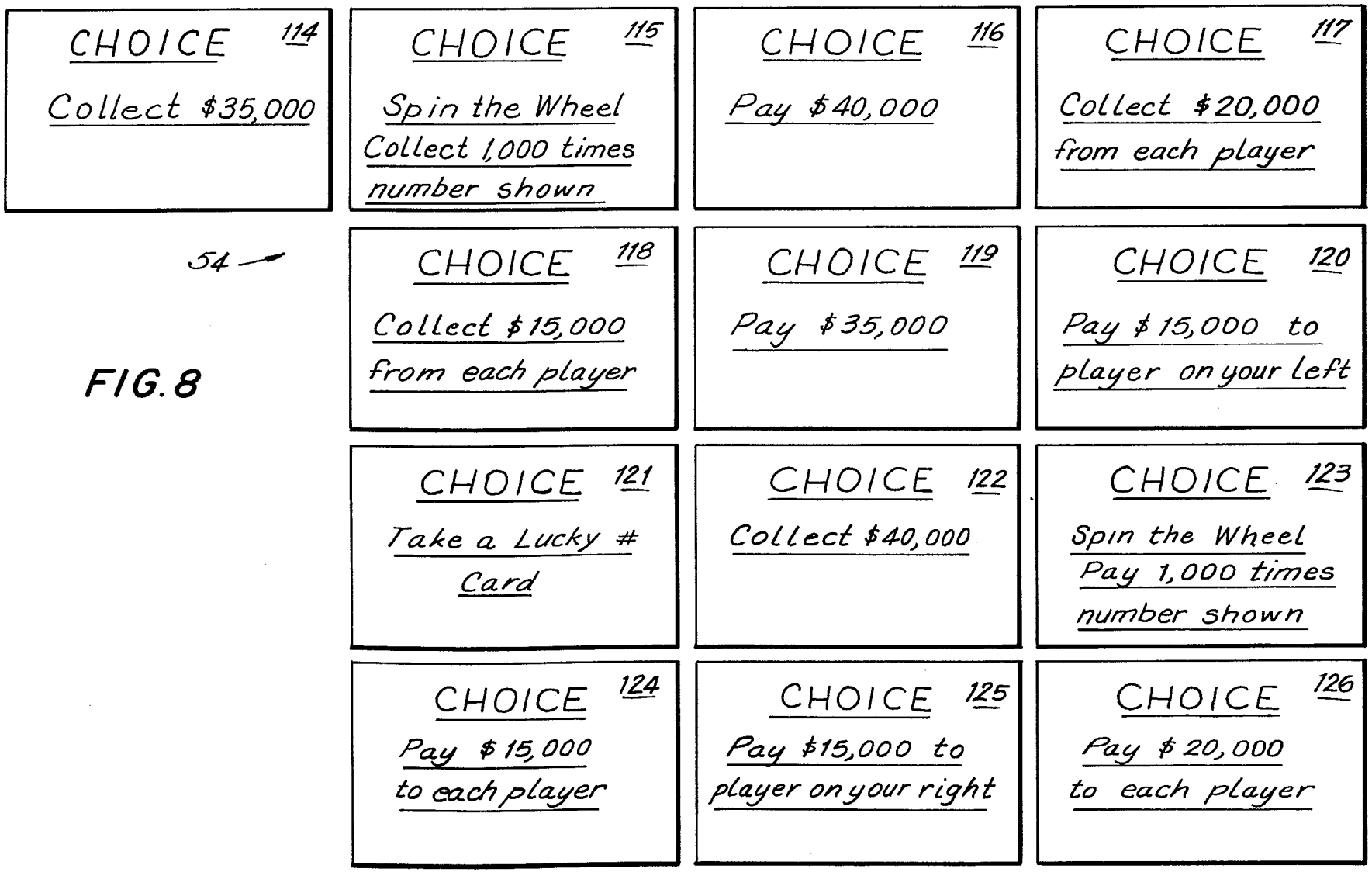
FIG. 8 is a pictorial representation of a deck of cards, each card having the indicia thereon indicating penalty and reward instructions.

A second deck of cards 54 is known as the Choice Cards. The cards of this deck are provided with indicia thereon indicating penalty or reward instructions, as for example, shown at 114 through 126 of FIG. 8. A player is directed to pick one of the Choice Cards from the deck placed face down in the area provided at 48 on the surface 14 of the playing board 12 when his distinctive token lands on a main course playing area directing him thereto. The player has the option of directing another player to comply with the instructions on the Choice Card or he may comply therewith himself, but, the decision must be made before the instructions on the card are exposed to view.

Figure 9:
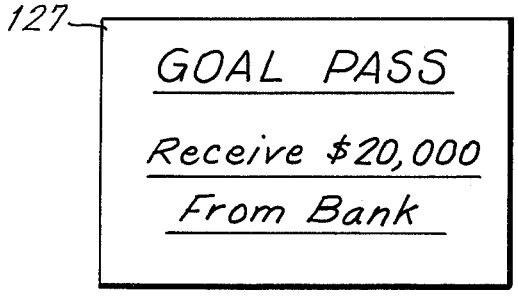
FIG. 9 is a pictorial representation of a Goal Pass Card.

In addition, a Goal Pass Card 127, as shown in FIG. 9 is provided. The Goal Pass Card is presented to a player each time his distinctive token passes the goal playing area 34 on the main course 16. These cards may be bought and sold by the players for monetary tokens 96 and when a prescribed number of them are acquired by one of the players the game is ended, and the player that has acquired the largest total value of monetary tokens is declared the winner.

The quantity of each of the types of cards and tokens is shown in the table below:

| Type of Card | Indicia on Card | Quantity |
|---|---|---|
| Lucky Number | 1 through 18 | 1 each |
| Goal Pass | Goal Pass<br>Receive $20,000 from Bank | 100 |
| Gambling | Pick 4 numbers<br>Bank pays 50 to 1<br>Limit $5,000 | 5 |
| Gambling | Pick Color<br>Bank Pays 3 to 1<br>Limit $25,000 | 5 |
| Gambling | Pick 10 Numbers<br>Bank Pays 20 to 1<br>Limit $5,000 | 5 |
| Gambling | Pick 8 Numbers<br>Bank Pays 30 to 1<br>Limit $10,000 | 5<br>Total 20 |
| Choice | Collect $35,000 | 3 |
| Choice | Spin the Wheel<br>Collect 1,000 times the number shown | 2 |
| Choice | Pay $40,000 | 3 |
| Choice | Collect $20,000 from each player | 2 |
| Choice | Collect $15,000 from each player | 3 |
| Choice | Pay $35,000 | 3 |
| Choice | Pay $15,000 to player on your left | 2 |
| Choice | Take a Lucky Number Card | 5 |
| Choice | Collect $40,000 | 3 |
| Choice | Spin the Wheel<br>Pay 1,000 times the number shown | 2 |
| Choice | Pay $15,000 to each player | 5 |
| Choice | Pay $15,000 to player on your right | 2 |
| Choice | Pay $20,000 to each player | 2<br>Total 37 |
| Monetary Tokens | $1,000 | 75 |
| Monetary Tokens | $5,000 | 75 |
| Monetary Tokens | $10,000 | 60 |
| Monetary Tokens | $20,000 | 50 |
| Monetary Tokens | $50,000 | 50 |
| Montary Tokens | $100,000 | 50 |
| Wagering Tokens | $1,000 (white) | 80 |
| Wagering Tokens | $5,000 (blue) | 40 |
| Wagering Tokens | $10,000 (red) | 40 |
| | | Total 520 |

The principles of the game are best described by a complete presentation of the rules of the game with examples to explain certain rules or instructions which may appear ambiguous.

At the start of the play, a Banker is chosen from among one of the players. The Banker is the bank's representative and handles the bank's money separately from the players' money. The Banker is responsible for issuing to each player the sum of $50,000 in monetary tokens preferably as follows: one $20,000 bill, one $10,000 bill, three $5,000 bills and five $1,000 bills. ($50,000 and $100,000 bills are also available for use during the game). The bank controls all the monetary tokens except those that have been issued to, or won by, the players. All formal bets (in accordance with instructions) are against the bank. Side bets may be made among the players.

Everytime a player passes the Goal playing area space 34 during the regular course of play, he collects a Goal Pass Card. When a player has collected five Goal Pass Cards, he collects $100,000 from the Bank and the game is over. All wagering chips are cashed at the bank and each of the players counts his money. The player having the largest total value of monetary tokens 92 (money) wins. Goal Pass Cards may be sold to other players at a mutually agreeable price before the fifth Goal Pass Card is issued. The playing time of the game can be increased by the players deciding that a greater number of Goal Pass Cards must be obtained to end the game. (Example: The possession of 10 Goal Pass Cards may be considered a completed game instead of five (5)). One player should be designated "Goal Pass Distributor" and have the responsibility of issuing Goal Pass Cards as required.

The Lucky Number Cards 52 are distributed, one to each player at the beginning of the game, each player obtaining a differently numbered card determined by a spin of the wheel 58; and the rest of the cards are placed face down on the space 46 provided. Each time one of these Lucky Numbers comes up on the dial indicator 56 during the play of the game, the player who owns that Lucky Number Card collects $20,000 from the bank, regardless of who spins the wheel or for what purpose. Players retain their Lucky Number Cards throughout the game. If a player draws a Lucky Number Card by following directions on a Choice card, the game rules apply and he also collects $20,000 every time the new number comes up. He also retains the card throughout the game. If a player's distinctive token lands on a numbered playing area space for which another player owns the Lucky Number Card, the other player collects $20,000 from that player. If a player's distinctive token lands on his own Lucky Number playing area, he collects $20,000 from every player. It is up to the player who has the Lucky Number Card to do the collecting. A player cannot mention the fact that another player's token has landed on his own number; if he does, he must pay a $10,000 penalty to the bank.

When a player's distinctive token lands on a numbered playing area 18, he is said to be vulnerable. This means that if a second player's distinctive token lands on this same playing area while the first player's token is still on it, the second player collects $10,000 from the first player plus the first player has to bring his distinctive token all the way back to the Goal playing area 34 without collecting any premiums. At the same time, the second player also becomes vulnerable. A player whose token lands in a numbered playing area is allowed to gamble at 50 to 1 odds, but he may only bet on the number appearing on the playing area upon which his token has landed. There is a $2,000 betting limit and a bet may not be made on a color. A player becomes vulnerable only when his token lands on a numbered playing area.

Whenever a player's token lands "on" or "passes" the Goal playing area 34, the following occurs: 1. He collects $20,000 from the bank. 2. He has the right to buy wagering tokens 103. 3. He receives a Goal Pass Card from the person designated to distribute them. (Exception: when a vulnerable player has been sent back to the Goal playing area 34.)

All players are allowed to purchase wagering or gambling chips 103 from the bank at the beginning of the game. The denominations of the chips 103 are: $1,000 white, $5,000 blue and $10,000 red. The only other time a player is allowed to purchase gambling chips 103 is when he passes the Goal playing area 34. Chips must be bought immediately after reaching or passing the Goal playing area and before the wheel is spun again for the next player's turn; otherwise, the right to buy chips at this time is forfeited. Once a chip has been bought, it cannot be cashed in until the end of the game. Chips of one value may not be exchanged for chips of another value. (Example: if you only have one chip of $5,000 and wish to gamble $1,000, you cannot. You either gamble the $5,000 chip or wait until you reach the Goal playing area where you may but chips of lower values.) Any number of red chips ($10,000) may be used on each number or color you bet, provided they do not exceed the limit, but only two white ($1,000) chips and one blue chip ($5,000) may be bet on any one number. You may not use two blue chips for a $10,000 bet or five white chips for a $5,000 bet. You may use only one blue chip and two white chips to equal $7,000; one red chip and two white chips to equal $12,000; one red chip, one blue chip and two white chips to equal $17,000; two red chips, one blue chip and two white chips to equal $27,000, etc., as long as the specified limit is not exceeded. One player may be made responsible for the distribution of the wagering chips 103.

When a player lands on a Gambling Card playing area 22, he takes a Gambling Card from the top of the Gambling Deck 50 and follows the directions thereon; he then returns the card, face up, to the bottom of the deck. When the last card is picked, the cards are reshuffled and placed face down, once again, on the board area 44.

When a player lands on a Gamble playing area 24, he may gamble up to the limit indicated on that area. A wager on a number pays 20 to 1 and a wager on a color pays two to one. He may choose up to five numbers and one color, but may not exceed the limit on each number or color that he chooses. (Example: If there is a $2,000 limit, he may bet $2,000 on each of the five numbers that he chooses plus $2,000 on one color for a total of $12,000.) Numbers wagered upon are indicated by placing chips on the numbers in the secondary playing area 38 provided on the board surface 14. Colors are chosen by placing chips on the green area 40 or red area 42 also provided on the board surface 14. A player's token landing on a Gamble playing area will not make him vulnerable.

The rotatable wheel 58 includes the numbers 1 through 18 plus 0 thereon. If a player spins the wheel 58 and it stops on any number from 1 to 18, he moves his distinctive token that number of spaces. (The numbers on the spinning wheel do not necessarily correspond to the sequence of numbers on the playing board.) If a player spins a zero (0) he pays the Bank $10,000 and loses that turn. If a player is gambling and spins a zero (0), he loses.

If a player spins the wheel 58 and obtains a 5, 10 or 15, he moves that number of playing areas and spins the wheel 58 again. If a player obtains any of these numbers three times in a row, he pays the Bank $10,000 and loses that turn. (Example: If a player spins 5, 5 and 10 or 5, 10, 15, etc.) Exception: When a player is gambling — this applies only on a player's regular turn to move.

When a player lands on a Choice Card playing area 28, he has the option of choosing a card from the Choice deck 54 or giving it to another player, but he must decide before he looks at the card. (The player chosen "MUST" accept the card and is required to follow the directions thereon.) Choice Cards carry the greatest rewards and the largest penalties. There are more penalties than rewards. If a player's token lands on a Choice Card space, he does not become vulnerable. The Choice card is returned to the bottom of the deck 54 face up; when the last card is placed, the cards are reshuffled and placed face down once again on board area 48.

When a player's token lands on a Safety playing area 20, he is not eligible to gamble and he does not become vulnerable. A safety playing area is a resting space.

If a player's token lands on a Pay playing area 26, he pays the Bank the amount indicated. No gambling is allowed in Pay areas. A player's token landing on a Pay area does not cause the player to become vulnerable.

If a player's token lands on a Collect playing area 30, he collects the amount indicated from the Bank. No gambling is allowed on Collect playing areas. If a player's token lands on a Collect playing area the player does not become vulnerable.

All of the players are allowed to make side bets during the game regardless of the location of their tokens, such as for example: a Choice 28, Safety 20, Pay 26 or Collect 30 playing area. They may bet on almost anything, such as for example, which player may be the first to reach the Goal, or the first to land on a Choice, Gambling Card, or Safety playing area. For this, the players may set up a kitty which is won by a player when his token arrives on the prescribed playing area.

A player is bankrupt when he loses all his money and chips, or when his money is invested in chips and he hasn't a sufficient amount thereto to pay a penalty or another player. He cannot borrow money from the Bank or from any other player. A bankrupt player must leave the game.

The game ends when either a player makes $500,000 (or any other amount specified at the beginning of the game), or a player obtains 5 Goal Pass Cards (or any other number of Goal Pass Cards specified at the beginning of the game). The player with the most money at the end of the game is declared the winner.

At the start of the game, each player picks a distinctive token to represent him and places it on the Goal playing area 34. The Gambling and Choice decks 50 and 54, respectively, are shuffled and placed face down on the boxes 44 and 48 provided on the game board. At this time the money is issued and all players are permitted to buy gambling chips 103 from the Chip Distributor. Thereafter, a player may purchase gambling chips only when he reaches or passes the Goal playing area as described earlier. Each player spins the wheel 58 for the right to start and choose a Lucky Number Card (it doesn't matter which player spins first). The player with the highest number starts the game and the player to his left is next, etc. The first player spins the wheel again. The number shown will be his Lucky Number for the rest of the game. A card with that Lucky Number is issued to him and he moves his distinctive token that number of spaces and not to the number shown on the wheel. The player to his left spins next; if his number is the same as the first player, he spins again until he gets a different number for which he will be given a Lucky Number Card; he also moves his distinctive token the number of spaces indicated by the wheel. Everytime a player's Lucky Number is indicated on the wheel, he gets $20,000 from the Bank. The next player spins and so on until each player has a Lucky Number Card and has moved the number of spaces indicated by the wheel. The first player spins again, etc. Lucky Numbers are only issued once except when obtaining a Choice Card with instructions thereon to obtain an additional Lucky Number Card 52.

To increase the game playing time, $100,000 may be issued to each player instead of $50,000. The number of Goal Passes to complete the game may be increased from 5 to 10 and the maximum amount of money to be acquired in order to win may be increased from $500,000 to $1,000,000.

It will be understood that various changes in the details, materials, arrangements of the playing areas, and the playing conditions for playing the game which have been herein described and illustrated in order to explain the nature of the invention, may be made by those skilled in the art within the principles and scope of the present invention.

Hereinbefore has been disclosed a board game apparatus which is adapted to provide enjoyment for children as well as adults. Although chance is a consideration in the game, a player with ability in money handling and wagering experience may readily accumulate the most money when the required number of Goal Pass Cards are acquired by one player to end the game.

What is claimed is:

1. A board game apparatus for a plurality of players comprising in combination a playing board having a continuous main course, said main course being divided into a plurality of adjacent playing areas, a portion of said plurality of main course playing areas having penalties, rewards, and instructions associated therewith to which said players must respond, the remaining portion of said plurality of main course playing areas being provided with numerical indicia thereon, said playing areas being randomly arranged to form said main course, said board further including differently colored playing areas disposed without said main course, a plurality of secondary playing areas having consecutive numerical indicia thereon disposed without said main course, each said secondary playing area corresponding to one of said main course playing areas having numerical indicia thereon, said playing board additionally including a generally centrally disposed dial indicator rotatably affixed thereon, said rotatable dial indicator having a plurality of areas, selected ones of which have numerical indicia thereon corresponding to the numerical indicia provided on said main course playing areas, said areas having colors corresponding to said differently colored playing areas, said rotatable dial indicator being capable of rotating and indicating a chance selected one of a plurality of numerical quantities when coming to rest, a plurality of distinctive tokens constituting playing pieces, one of said tokens being utilized by each of said players in playing said game, monetary tokens for payment of rewards and penalties by players whose distinctive token lands on a main playing area having such instructions thereon, wagering tokens for placement on said secondary playing areas and said colored areas to indicate the areas selected and the amount wagered, a plurality of cards, each said card having a numerical indicia thereon corresponding to one of said main path numerical indicia, said cards being acquired by said players under prescribed conditions, ownership of said numerical cards providing rewards of said monetary tokens under specific conditions, and two decks of cards, the cards of one of said decks of cards having indicia thereon indicating wagering instructions, the cards of the other of said decks of cards having indicia thereon indicating penalty or reward instructions, and a player being directed to select a card from one of said decks of cards by instructions provided on selected ones of said main course playing areas.

2. A board game apparatus according to claim 1, wherein said main course is generally disposed in a circular shaped path.

3. A board game apparatus according to claim 1, wherein said secondary playing areas are aligned in a straight line in double file and are generally equally accessible to all of said players.

4. A board game apparatus according to claim 1, wherein said dial indicator includes a rotatable wheel and a coacting indexing post, said wheel being provided with a plurality of areas each having numerical indicia thereon corresponding to the numerical indicia provided on one of said main course playing areas, and said wheel areas also being alternatively provided with said different colors.

5. A board game apparatus according to claim 4, wherein said wheel areas are substantially equal in size.

6. A board game apparatus according to claim 4, wherein said rotatable wheel includes a plurality of protrusion means for rotating said wheel.

7. A board game apparatus according to claim 1, including areas marked on said board for placing said decks of cards.

8. A board game apparatus according to claim 1, including an area marked on said board for placing said cards with numerical indicia thereon.

9. A board game apparatus according to claim 1, wherein each of said portions of said main course playing areas comprise one-half of the total number of said main course playing areas.

10. A board game apparatus according to claim 1, wherein two of said differently colored playing areas are provided.

11. A board game apparatus according to claim 10, wherein said differently colored playing areas are red and green.

12. A board game apparatus according to claim 1, wherein said main course playing areas are substantially of equal size.

* * * * *